US005332366A

United States Patent [19]

Anderson

[11] Patent Number: 5,332,366

[45] Date of Patent: Jul. 26, 1994

[54] CONCRETE PUMP MONITORING SYSTEM

[75] Inventor: Thomas M. Anderson, White Bear Lake, Minn.

[73] Assignee: Schwing America, Inc., White Bear, Minn.

[21] Appl. No.: 7,747

[22] Filed: Jan. 22, 1993

[51] Int. Cl.[5] ..... F04B 21/00

[52] U.S. Cl. ..... 417/63; 417/53; 417/900

[58] Field of Search ..... 417/63, 342, 347, 900, 417/317, 53; 73/3, 239

[56] References Cited

U.S. PATENT DOCUMENTS

| | | | |
|---|---|---|---|
| 3,650,638 | 3/1972 | Cole | 417/346 |
| 4,465,441 | 8/1984 | Schwing | 417/517 |
| 4,472,118 | 9/1984 | Schwing | 417/517 |
| 4,543,044 | 9/1985 | Simmons | 417/342 |
| 4,545,736 | 10/1985 | Walton | 417/63 |
| 4,605,356 | 8/1986 | Uchida et al. | 417/900 |
| 4,611,973 | 9/1986 | Birdwell | 417/342 |
| 4,681,513 | 7/1987 | Saito et al. | 417/63 |
| 4,781,066 | 11/1988 | Pope et al. | 73/239 |
| 4,790,728 | 12/1988 | Dwyer | 417/342 |
| 4,850,805 | 7/1989 | Madsen et al. | 417/63 |
| 4,938,054 | 7/1990 | Dye et al. | 73/3 |
| 5,106,272 | 4/1992 | Oakley et al. | 417/347 |
| 5,222,867 | 6/1993 | Walker, Sr. et al. | 417/63 |
| 5,257,912 | 11/1993 | Oakley et al. | 417/63 |

OTHER PUBLICATIONS

Concrete Pumping, vol. 8, No. 1, Winter 1992-1993, p. 44, "Mobile Computers Make Pumping Operations More Profitable".

*Primary Examiner*—Richard A. Bertsch
*Assistant Examiner*—Charles G. Freay
*Attorney, Agent, or Firm*—Kinney & Lange

[57] ABSTRACT

A system for monitoring the transport of concrete includes a computer, pump sensors, and a positive displacement pump for pumping concrete through a pipeline. The monitoring system senses and records the number of pump strokes and the pumping pressure during each pump stroke. The actual volume and instantaneous pumping rates of concrete pumped during each pump stroke are calculated. Based upon a calculated velocity and upon the pressure of the concrete being pumped, the monitoring system provides predicted component wear information for maintenance scheduling and warranty verification.

13 Claims, 2 Drawing Sheets

CONCRETE PUMP MONITORING SYSTEM

BACKGROUND OF THE INVENTION

The present invention relates to systems for transporting high solids materials such as concrete. In particular, the present invention relates to a concrete pump monitoring system which monitors the operation of a concrete pump and provides its owners and operators with information relating to the operational performance of the pump and generates maintenance and warranty information based upon the operational performance.

Positive displacement pumps are frequently used for conveying concrete and other materials through pipelines in construction applications. An example of a positive displacement pump of this type is shown in Oakley et al., U.S. Pat. No. 5,106,272 entitled SLUDGE FLOW MEASURING SYSTEM. Positive displacement pumps offer a number of significant advantages over screw or belt conveyors in the pumping of materials such as concrete. For example, positive displacement pumps are capable of pumping thick, heavy materials which may not be practical for screw conveyors. Pump and pipeline systems also take up less space than screw or belt conveyors and, with the use of simple elbow pipes, are capable of transporting concrete around corners. Additionally, positive displacement pumps offer a reduction in noise over mechanical conveyors, as well as greater cleanliness and reduced spillage.

In concrete pumping applications, it is becoming increasingly necessary to accurately measure the quantity of concrete pumped. Even more importantly, owners must schedule the proper maintenance and replacement of pump and pipeline components prior to a component failure during use. This prevents unnecessary and costly loss of time due to system failures, as well as the inefficient waste of concrete which may become unusable as a result of the delays associated with the failure of a pump or pipeline component. At the same time, for economic reasons, it is desirable to schedule the maintenance and replacement of pump and pipeline components only when necessary.

In the concrete pumping business, pump maintenance is typically scheduled based upon the number of cubic yards of concrete that have been pumped. The pump owner frequently estimates the cubic yardage of concrete pumped by referring to the concrete supplier delivery tickets. Additionally, current methods of scheduling maintenance do not take into account factors such as the type of concrete which has been pumped or the rate at which it was pumped. Different types of concrete have different abrasion characteristics and, when pumped at any given velocity, will cause different amounts of wear, and require different pumping pressures. All of these factors lead to uncertainty as to when maintenance needs to be scheduled. Additionally, these factors make it difficult for pump and pipeline manufacturers to verify warranty related information.

SUMMARY OF THE INVENTION

The present invention is based upon the recognition that a positive displacement pump, together with a system which monitors the operational parameters of the pump and which is capable of calculating theoretical and actual volumes of concrete pumped, instantaneous pumping rates, and the pumping pressure during each pumping stroke, offers the combined capability of accurate volume and flow rate measurement as well as the capability to predict pump and pipeline component wear and to generate maintenance and warranty information.

It is not normally possible to fill the cylinders of a positive displacement pump to 100 percent of the known capacity. Therefore, a portion of each pumping stroke of the positive displacement pump involves traveling through voids to pressurize the concrete. While traveling through voids in the cylinder, little force is required to move the piston. In the present invention, at least one parameter related to the operation of the positive displacement pump is sensed in order to identify the point during the pumping stroke when the hydraulic pressure applied to the piston is sufficient to exceed a predetermined value. From that information, the actual volume of material being pumped during that pumping stroke is determined. By accumulating the actual volume pumped during each stroke, an accumulated actual volume is determined. By dividing the actual volume pumped during one or more pumping cycles by the time that elapses during the pumping cycles, an instantaneous pumping rate can be determined.

In one preferred embodiment, the monitoring system of the present invention senses a parameter related to the operation of the pump which bears a known relationship to an actual volume of concrete delivered during a pumping cycle. From the sensed parameter, an output value is determined which represents an actual volume of concrete delivered by the pump during a pumping cycle. The actual volume of concrete delivered is stored in the memory of the monitoring system of the present invention. The monitoring system of the present invention then provides the stored information on actual volume pumped to pump users.

In another embodiment, the monitor system of the present invention calculates an actual volume pumped and an instantaneous pumping rate for each pump stroke and over a plurality of pumping strokes. The monitoring system also senses the pumping pressure during each of the pump strokes. Next, the velocity of the concrete pumped is calculated. Finally, the monitoring system predicts pump and pipeline component wear based upon the velocity of the concrete pumped and the pumping pressure during each pumping stroke. The predicted wear information is stored and provided to owners of the pump upon request for maintenance scheduling and warranty verification.

DETAILED DESCRIPTION OF THE PREFERRED EMBODIMENTS

A. Overview of Pump 10

Figure 1:
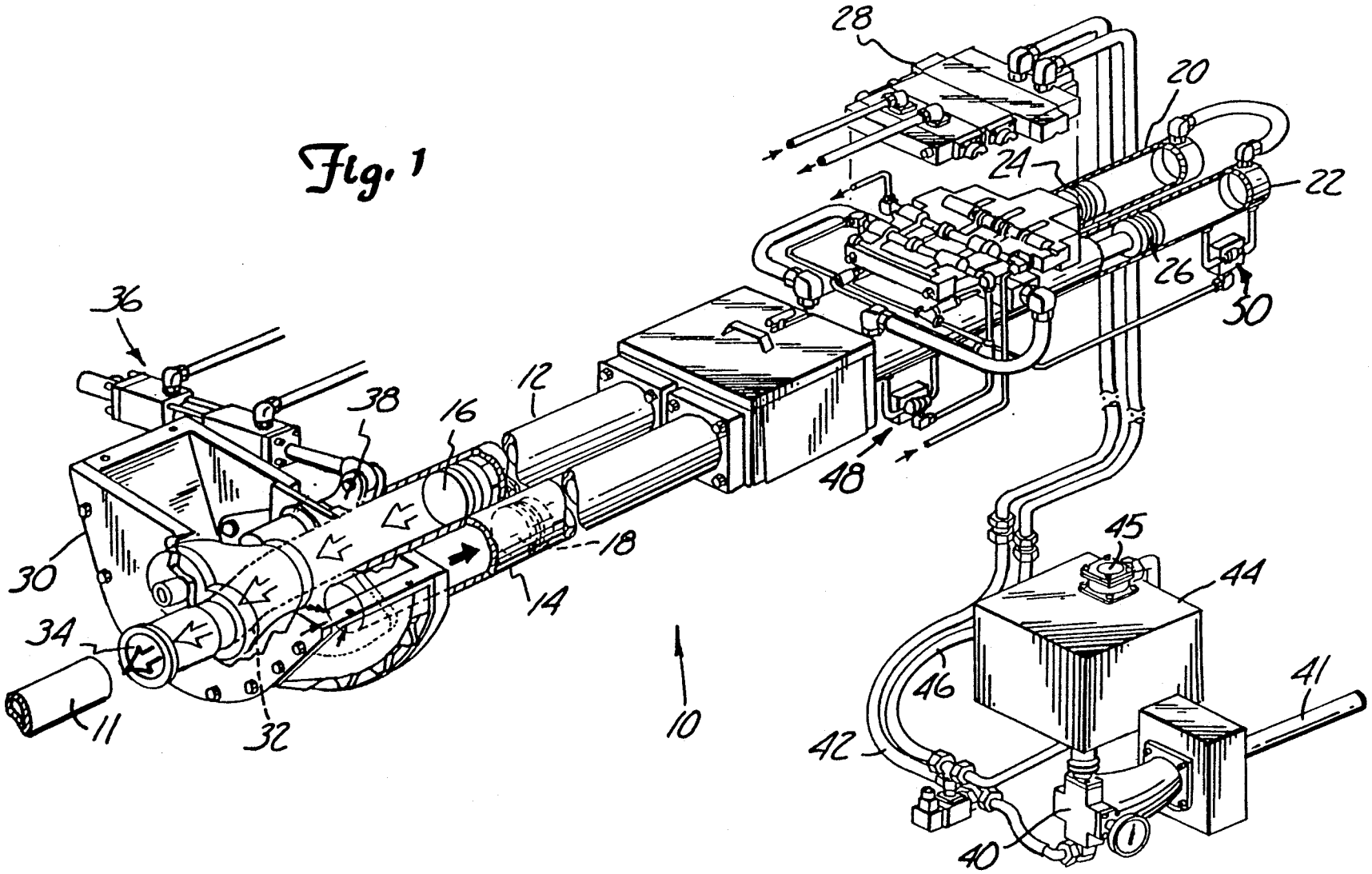
FIG. 1 is a perspective view, with portions broken away and portions exploded, of a concrete pump and pipeline.

FIG. 1 shows two-cylinder, hydraulically-driven, positive displacement material pump 10 and pipeline 11 which is connectable to pump 10. Pump 10 includes material cylinders 12 and 14, material pistons 16 and 18, hydraulic drive cylinders 20 and 22, drive pistons 24 and 26, valve assembly 28, hopper 30, pivoting transfer tube 32, outlet 34, hydraulic actuators 36, pivot arm 38, hydraulic pump 40, input shaft 41, high pressure lines 42, hydraulic reservoir 44, filter 45, low pressure lines 46, and forward and rear switching valves 48 and 50.

Material pistons 16 and 18 reciprocate in material cylinders 12 and 14 respectively. Hydraulic drive cylinders 20 and 22 have drive pistons 24 and 26, respectively, which are connected to material pistons 16 and 18, respectively. Valve assembly 28 controls the sequencing of movement of pistons 24 and 26, and thus the movement of pistons 16 and 18 in material cylinders 12 and 14.

Concrete or other material is supplied to hopper 30, in which a pivoting transfer tube 32 is positioned. It should be noted that pivoting transfer tube 32 represents only one type of material valve, and that other types can be used as well. Transfer tube 32 connects outlet 34 with one of the two material cylinders (in FIG. 1, outlet 34 is connected to cylinder 12), while the inlet to the other material cylinder (in this case, cylinder 14) is opened to the interior of hopper 30. In FIG. 1, piston 16 is moving forward in a discharge stroke to pump material out of cylinder 12 to outlet 34, while piston 18 is moving rearward to draw material into cylinder 14. Outlet 34 may be connected to pipeline 11 so that concrete is pumped through outlet 34 into pipeline 11.

At the end of the stroke, hydraulic actuator 36 which is connected to pivot arm 38 causes transfer tube 32 to swing so that outlet 34 is now connected to cylinder 14. Then, the direction of movement of pistons 16 and 18 reverses, with piston 18 now moving forward in a discharge stroke while piston 16 now moves backward in a filling or loading stroke.

Valve assembly 28 is coupled to hydraulic pump 40 and hydraulic reservoir 44 through high and low pressure lines 42 and 46 respectively. Oil or any other type of hydraulic fluid is pumped from hydraulic pump 40 through high pressure lines 42 to control valve assembly 28. Valve assembly 28 includes check valves which control the sequencing of high and low pressure hydraulic fluid to hydraulic cylinders 20 and 22 and to hydraulic actuator 36 in a known manner. Low pressure hydraulic fluid returns to hydraulic reservoir 44 through filter 45 from valve assembly 28 via low pressure line 46.

Forward and rear switching valves 48 and 50 sense the position of piston 26 at the forward and rear ends of travel and are interconnected to control valve assembly 28. Each time piston 26 reaches the forward or rear end of its travel in cylinder 22, a valve sequence is initiated which results in transfer tube 32 swinging so that outlet 34 is connected to the other material cylinder 12 or 14 which has just completed a filling stroke. The valve sequence also results in a reversal of the high pressure and low pressure connections to cylinders 20 and 22.

The sequence of operations of pump 10 is generally as follows. As the drive pistons 24 and 26 come to the end of their stroke, one of the material cylinders (in FIG. 1, cylinder 12) is discharging material to outlet 34, while the other cylinder 14 is loading material through its inlet from hopper 30. At the end of the pumping stroke, material piston 16 is at its closest point to outlet 34, while piston 18 is at a position furthest from outlet 34. At this point, switching valve 50 senses that hydraulic drive piston 26 has reached the rearward end of its stroke. Valve assembly 28 and hydraulic actuator 36 are activated which causes transfer tube 32 to swing so that outlet 34 is now connected to cylinder 14 instead of cylinder 16. The operation continues with one material piston 14 or 16 operating in a filling stroke, while the other is operating in a pumping or discharge stroke.

B. Monitor System 100

Figure 2:
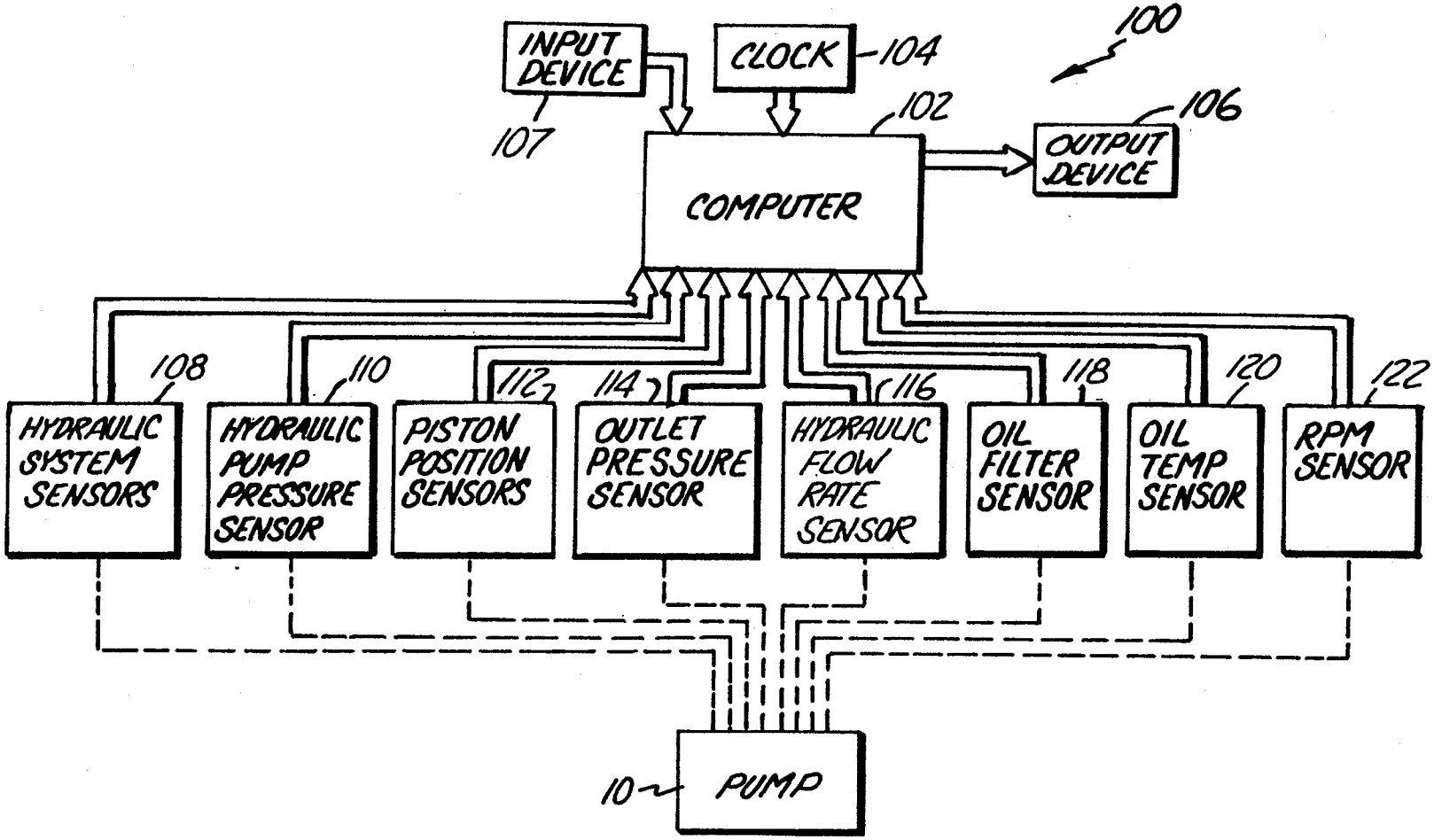
FIG. 2 is a block diagram of the concrete pump monitoring system of the present invention.

FIG. 2 shows a preferred embodiment of the present invention in which operation of concrete pump 10 is monitored by system 100 to provide the owners and operators of concrete pump 10 with accurate operational, diagnostic and maintenance information. Monitor system 100 includes computer 102, which in a preferred embodiment is a microprocessor-based computer including associated memory and associated input/output circuitry. Monitor system 100 also includes clock 104, output device 106, input device 107, and pump sensors 108–122 which will be described later in greater detail.

In other embodiments of the present invention, monitoring system 100 includes a programmable logic controller (PLC) instead of computer 102.

Clock 104 provides a time base for computer 102. Although shown separately in FIG. 2, clock 104 is, in preferred embodiments of the present invention, contained as a part of computer 102.

Output device 106 is preferably any of a number of devices. For example, output device 106 can include a display output such as a cathode ray tube or liquid crystal display. Output device 106 can also be a printer, or a communication device such as a cellular phone which transmits the output of computer 102 to another computer-based system (which may monitor the overall operation in which pump 10 is being used). Input device 107 can also take a variety of forms. In one preferred embodiment, input device 107 is a keypad entry device. Input device 107 can also be a keyboard, a remote program device or any other suitable mechanism for providing information to computer 102.

C. Pump Sensors 108–122

Pump sensors 108–122 monitor the operation of pump 10 and provide signals, representative of pump operation, to computer 102. The parameters sensed by pump sensors 108–122 provide various indications of pump operation and performance and provide computer 102 with information needed to generate performance and diagnostic information for the pump's owner and operator. In preferred embodiments of the present invention, computer 102 is also programmed to control certain operational aspects of pump 10 in response to the signals received by sensors 108–122.

It should be understood that monitoring system 100 may include some or all of sensors 108–122. Some of sensors 108–122 provide computer 102 with duplicative information and could therefore, in other embodiments, be omitted from monitoring system 100. Hydraulic system sensors 108 provide an indication to computer 102 of the start of each pumping stroke in pump 10. Sensors 108 also provide an indication of the time at which each pumping stroke ends. Additionally, hydraulic system sensors 108 provide information to computer 102 on other hydraulically controlled functions of pump 10 such as the position and operation of transfer tube 32 which swings to connect a different material cylinder 12 or 14 to outlet 34 at the completion of each pumping stroke.

Hydraulic pump pressure sensor 110 senses the pressure of the hydraulic fluid on the high pressure side of pump 10. In addition to supplying computer 102 with hydraulic pressure information, hydraulic pressure signals from sensor 110 are preferably monitored to obtain other information such as the start and stop times of each pumping stroke.

Piston position sensors 112 sense the position of each of the pistons of pump 10 during pumping strokes. From the signals supplied by piston position sensors 112, the starting and stopping points of each pumping stroke are also known. The signals from piston position sensors 112 are, in a preferred embodiment, a digital value. For example, piston position sensors 112 are preferably linear displacement sensors (which may be analog sensors), coupled to an analog-to-digital converter so that the data supplied to computer 102 is in a digital form.

Outlet pressure sensor 114 is preferably an analog pressure sensor or a digital pressure sensor. Outlet pressure sensor 114, as will be discussed later in greater detail, provides computer 102 with signals which, in conjunction with signals from hydraulic pump pressure sensor 110, are indicative of a pump efficiency or fill percentage.

Hyrdraulic flow rate sensor 116 are preferably located near hydraulic pump 40 and sense the flow rate of hydraulic fluid from pump 40. Sensors 116 are also preferably used to provide an indication to computer 102 that the velocity of pistons 24 and 26 have remained essentially constant during the pumping cycle. Hydraulic flow rate sensor 116 is preferably in the form of a digitally converted analog signal to computer 102. In other preferred embodiments, piston velocity is not intended to remain constant, and therefore, sensor 116 is used to adjust the calculated actual concrete volume.

Oil filter sensor 118 senses a change in pressure across oil filter 45 in hydraulic reservoir 44. This information is used to determine whether the oil filter is dirty and needs to be replaced.

Oil temperature sensor 120 senses the temperature of the hydraulic fluid in hydraulic reservoir 44. This information is used to monitor pump 10 for excessive temperature conditions. In preferred embodiments, computer 102 ignores information from sensor 118 until sensor 120 indicates that hydraulic fluid is at normal operating temperatures.

RPM sensor 122 is a proximity switch located on the input shaft 41 to hydraulic pump 40. Signals from RPM sensor 122 provide computer 102 with information relating to the current speed at which hydraulic pump 40 is being driven.

D. General Information Sensed

In one preferred embodiment of the present invention, computer 102 monitors the number of pumping strokes by pump 10 and calculates a theoretical volume of concrete pumped. Hydraulic system sensors 108 provide signals to computer 102 which indicate the start and stop of each pumping stroke. Computer 102 uses these signals to count the number of pumping strokes and stores this data in its associated memory. Computer 102 than calculates, based upon the counted number of strokes and upon the known volume of material cylinders 12 and 14, a theoretical volume of concrete pumped. Information relating to the number of pump strokes and the theoretical volume of concrete pumped is stored in the memory of computer 102 for use in predicting wear of pump and pipeline components and for scheduling maintenance. Information on the number of pump strokes and theoretical volume pumped, as well as the generated maintenance information, may be accessed by the user of monitoring system 100 through output device 106.

In alternative embodiments, computer 102 receives information relating to the number of pumping strokes performed by pump 10 from signals provided by hydraulic pump pressure sensor 110 or piston position sensors 112 instead of hydraulic system sensors 108. Using the signals received by one or more of sensors 108, 110, and 112, computer 102 generates and stores data which indicates the total number of strokes and the total theoretical volume pumped by pump 10 over a predetermined period of time, during the current pumping application, since the last maintenance of the pump, and since pump 10 was new.

In another embodiment, hydraulic pump pressure sensor 110 monitors the hydraulic pump pressure during each pumping cycle and provides this information to computer 102. Computer 102 stores this information and provides the user with information indicating the current pumping pressure, the average pumping pressure over a period of time or over a number of strokes, the highest pumping pressure since the last pump maintenance, and the highest pumping pressure ever experienced by pump 10.

E. Actual Volume and Percentage Fill

In another preferred embodiment of the present invention, computer 102 calculates, for each pumping stroke, a pump efficiency rating or fill percentage. Depending upon the pumpability of the concrete being used, material cylinders 12 and 14 will not likely be totally filled with concrete during a loading stroke. Knowing the total displacement volume of material cylinders 12 and 14, and knowing the fill percentage of the material cylinders during each stroke, computer 102 can calculate an actual volume pumped during any given stroke.

The percentage fill can be determined as follows. As discussed previously, computer 102 receives signals from hydraulic system sensors 108, hydraulic pump pressure sensor 110, or piston positions sensors 112 which are indicative of the beginning of each pumping stroke. As material pistons 16 and 18 travel through material cylinders 12 and 14 during their respective pumping strokes, concrete in the material cylinder is compacted. When the concrete is near fully compacted, the pressure in material cylinders 12 and 14 respectively, and thus the hydraulic pressure in hydraulic drive cylinders 20 and 22 respectively, increases. Computer 102 monitors the signal from hydraulic pump pressure sensor 110. When the signal from sensor 110 indicates to computer 102 that the hydraulic pressure in pump 10 has exceeded a predetermined value, computer 102 records that time (or, in the alternative, the piston position) during the pumping stroke. In alternative embodiments, computer 102 does not compare the hydraulic pump pressure to a predetermined value, but rather to the pressure of the concrete at the outlet of pump 10 or in pipeline 11 which is provided to computer 102 by outlet pressure sensor 114.

Computer 102 next receives a signal from sensors 108, sensor 110, or sensors 112 which indicates that the pumping stroke is completed. Because it is known that concrete can be pushed from material cylinders 12 and 14 only when the hydraulic pressure obtains some known relationship to the predetermined value, computer 102 can determine an efficiency rating or fill percentage by dividing the pumping stroke time (or distance traveled) after the predetermined hydraulic pressure was exceeded by the total pumping stroke time (or distance traveled). Based upon signals from hydraulic flow rate sensor 116, computer 102 determines whether the velocity of pistons 16 and 18 remained essentially constant through the pumping stroke. If computer 102 determines that the velocity did not remain essentially constant, adjustments must be made because this method of calculating fill percentage is actually based upon the ratio of the length of the stroke after the predetermined value has been exceeded to the total stroke length.

The fill percentage for each stroke is stored in a register within the memory of computer 102. Since the total displacement volume of material cylinders 12 and 14 is known, computer 102 can, using the calculated fill percentage, determine an actual volume pumped during each stroke. In addition, computer 102 updates a register which keeps an accumulated total of actual volume pumped.

Using clock input signals from clock 104, computer 102 can determine the length of time of each pumping stroke and an accumulated length of time during which the accumulated total of actual volume was pumped. With this information, computer 102 calculates an instantaneous pumping rate for each cycle, as well as an average pumping rate over the accumulated time. All four values (actual volume pumped in a particular cycle, actual total accumulated volume, instantaneous pumping rate, and average pumping rate) are stored in the memory of computer 102 and can be displayed by output device 106. Typically, the operator will select the particular information to be displayed by providing a command through input device 108 to computer 102. Computer 102 also generates a fill efficiency for the last pump stroke, as well as average fill efficiencies over predetermined numbers of strokes or periods of time.

The actual volume of concrete pumped by pump 10 is a more reliable indicator of component wear on some components of pump 10 and pipeline 11 than is the theoretical volume of concrete pumped. Therefore, this information is useful in scheduling the maintenance and replacement of parts for pump 10 and pipeline 11. In a preferred embodiment of the present invention, computer 102 stores information relating to the actual volume of concrete pumped by pump 10 over several different time periods. These actual volumes and time periods include the actual volume pumped per stroke, that actual volume pumped over some predetermined number of strokes or period of time, the actual volume pumped during a particular job or pumping application, and the actual volume pumped over the life of pump 10 since it was new and since its last scheduled maintenance. Computer 102 then uses this stored information to generate maintenance schedules or adjust existing maintenance schedules.

In other preferred embodiments of the present invention, information relating to the actual volumes of concrete pumped, as well as other information such as pumping pressures or the total number of pumping strokes is resettable only by those who posess a pre-programmed access code. This permits the pumps owners or manufacturers to verify information relating to alleged uses of pump 10, and is a useful tool for providing accurate warranty information.

F. Velocity of Concrete Pumped

Three major factors affect the rate that concrete pump and pipeline components experience wear. The type of concrete being pumped, the velocity at which the concrete is pumped, and the pumping pressure all greatly affect component wear. These three factors are each dependent on one another as well. Although it is possible to predict the amount of component wear based, at least in part, upon the type of concrete being pumped, an easier and more reliable method of predicting concrete wear is to base the predictions on the velocity and pressure at which the concrete is pumped.

Using the methods described above to determine the actual volume of concrete pumped per stroke and the instantaneous pumping rate, the velocity of the concrete pumped may be determined. Since the methods described above may be used to determine the instantaneous volumetric flow rate of concrete pumped by pump 10, and since the cross-sectional areas of pump outlet 34 and pipeline 11 are known, the velocity of pumped concrete may be calculated by computer 102 for each pumping stroke. Also as described previously, by monitoring the signal from hydraulic pump pressure sensor 104, computer 102 can determine the pump pushing pressure during the portion of each pumping stroke in which concrete is actually pushed from material cylinders 12 and 14. Computer 102 then uses the velocity and pressure information from each pumping stroke to calculate or update maintenance information for the components of concrete pump 10 and pipeline 11.

G. Predicting Wear and Adjustment of Maintenance and Warranty Information

In one preferred embodiment, a method of predicting the rate at which pump 10 and pipeline 11 will experience wear is to monitor the operation of pump 10 as it pumps concrete at an average velocity and under an average pumping pressure to determine, on average, how many cubic yards can be pumped before pump 10 and pipeline 11 components need replacement. Using this method, the average velocity and the average pumping pressure are multiplied together to obtain a wear reference value $W_R$. Then, during normal pumping operations, computer 102 monitors the actual pumping pressure and calculates the actual concrete pumping velocity using the methods previously described. Computer 102 multiplies the actual pumping pressure by the actual pumping velocity to obtain an actual wear index $W_A$. Computer 102 next compares wear reference value $W_R$ to actual wear index $W_A$. If actual wear index $W_A$ is less than wear reference value $W_R$, pump 10 and pipeline 11 components can be expected to pump a higher than average volume before needing to be replaced. However, if $W_A$ is determined to be greater than $W_R$, pump 10 and pipeline 11 components can be expected to require replacement before the average volume of concrete has been pumped. In either case, computer 102 adjusts the maintenance and warranty schedules appropriately.

For example, assume that an average pumping pressure is 2,000 p.s.i. and that an average velocity is 2 yards per minute. Also assume that under these conditions, on average, a particular section of pipeline 11 requires replacement after 15,000 cubic yards of concrete have been pumped. In this case, a wear reference value $W_R$ of 4,000 would be input into computer 102. Next, assume that over a period of time, an average actual pumping pressure of 2,500 p.s.i. and an average actual pumping velocity of 2.1 yards per minute is observed by monitoring system 100. Computer 102 multiplies the average actual pumping pressure and the average actual pumping velocity to obtain an actual wear index of 5,250. Since the actual wear index far exceeds the wear reference value, less than 15,000 cubic yards of concrete can be pumped through the pipeline section before replacement is required. Therefore, computer 102 adjusts maintenance and warranty information appropriately.

In another preferred embodiment, computer 102 further adjusts the maintenance and warranty information to reflect component wear that results from operation of pump 10 when the hydraulic pressure is below the predetermined value. If pump 10 is operating without concrete being fed into hopper 30, or if a blockage prevented concrete from being loaded into material cylinders 12 and 14, pump 10 has pumping strokes without sufficient pushing pressure, and therefore these strokes are not counted by computer 102 in the actual volume of concrete pumped. In addition, the portion of each pumping stroke during which concrete is compacted but not pushed from the material cylinders is not included in the actual volume of concrete pumped. Nonetheless, operation of pump 10 during these times when concrete is not being pushed from material cylinders 12 and 14 still causes some component wear. Therefore, computer 102 adjusts the maintenance schedules and warranty information accordingly.

While most concrete pump components experience wear based largely upon either the actual or theoretical cubic yards pumped, hydraulic oil experiences wear largely as a function of total hours of pump operation. Using clock 104, computer 102 monitors the total hours of pump operation and stores this information in an associated memory register. This information can be used to schedule maintenance and is available to the pump owner, through output device 106. Computer 102 may also supply the pump owner with information on the total hours of pump operation during this concrete pumping application, since the last concrete pump maintenance, and since the pump was new.

Although the above mentioned preferred embodiments of the present invention illustrate various methods of predicting component wear, certain of these components will experience damage under excessive oil temperatures. By monitoring signals from oil temperature sensor 120, computer 102 monitors the operation of pump 10 and records the times and conditions in which the oil temperature exceeded a predetermine value. Based upon the length of time that excessive oil temperatures exist, computer 102 can inform interested parties of impending component failure.

H. Conclusion

Monitoring system 100 of the present invention monitors operational parameters of pump 10. Computer 102 of monitoring system 100 calculates and stores information representing the number of pumping strokes and the pump pushing pressure during each of these strokes. Next, computer 102 determines a fill percentage for material cylinders 12 and 14 during respective pumping strokes in each cylinder. This information is used to calculate actual and theoretical volumes pumped, as well as instantaneous pumping rates and a pumping rate over a period of time.

In one embodiment of the present invention, computer 102 generates maintenance and warranty information based, at least in part, upon the theoretical volume of concrete pumped by pump 10. In another embodiment, maintenance and warranty information is generated based upon the actual volume of concrete pumped. In yet another preferred embodiment, computer 102 predicts component wear, and therefore generates maintenance and warranty information, based upon a combination of the velocity and the pressure at which concrete is pumped by pump 10.

Monitoring system 100 provides the owners and operators of pump 10 with a diagnostic tool for accurately determining the operational performance of pump and pipeline components. Monitoring system 100, with computer 102 which stores information representative of the operating conditions and performance of pump 10, provides a means for pump and pipeline owners and manufacturers to verify maintenance and warranty information as well.

Although the present invention has been described with reference to preferred embodiments, workers skilled in the art will recognize that changes may be made in form and detail without departing from the spirit and scope of the invention. For example, monitoring system 100 of the present invention could be used to monitor positive displacement pumps with different material valves than transfer tube 32 and different hydraulic oil routing devices than valve assembly 28 of pump 10.

What is claimed is:

1. A method of monitoring operation of a positive displacement concrete pump having an inlet for receiving concrete and an outlet at which concrete is delivered under pressure, the method comprising:

sensing a parameter which bears a known relationship to an actual volume of concrete delivered under pressure from a material cylinder of the pump;

determining velocity information as a function of the parameter sensed, the velocity information being related to a velocity of concrete delivered under pressure from the material cylinder of the pump; and predicting wear on pump components as a function of the determined velocity information.

2. The method of claim 1 and further comprising:

updating a pump maintenance schedule as a function of predicted wear on pump components.

3. The method of claim 1 wherein determining velocity information further comprises:

determining an average velocity of concrete delivered under pressure from the material cylinder of the pump.

4. The method of claim 1 wherein predicting wear on pump components further comprises:

sensing a pressure indicative parameter which bears a known relationship to a pressure of concrete delivered under pressure from the material cylinder of the pump;

determining pressure information as a function of the sensed pressure indicative parameter, the pressure information being related to a pressure of concrete delivered from the material cylinder of the pump; and predicting wear on pump components as a function of both the determined velocity information and the determined pressure information.

5. The method of claim 4 wherein determining pressure information further comprises:

determining an average pressure of concrete delivered from the material cylinder of the pump.

6. The method of claim 1 and further comprising:

generating pump maintenance information as a function of the predicted wear on pump components.

7. A method of monitoring operation of a positive displacement piston/cylinder concrete pump which receives concrete at a pump inlet during filling stroked and delivers concrete to a pipeline at a pump outlet during pumping strokes, the method comprising:

sensing a parameter which bears a known relationship to a flow of concrete out of a cylinder of the pump;

determining from the parameter sensed an actual volume of concrete delivered to the pipeline from the cylinder of the pump;

determining velocity information as a function of the actual volume of concrete delivered to the pipeline, the velocity information being related to a velocity of concrete delivered to the pipeline from the cylinder of the pump;

predicting wear on pump components as a function of the velocity information; and providing an output signal as a function of the predicted wear on components of the pump and pipeline.

8. The method of claim 7 wherein the output signal represents predicted wear on components of the pump and pipeline.

9. The method of claim 7 wherein the output signal represents a predicted quantity of concrete which may be pumped before pump and pipeline components will require maintenance.

10. The method of claim 7 and further comprising:

generating warranty information as a function of the output signal.

11. The method of claim 7 wherein determining velocity information further comprises:

determining an average velocity of concrete delivered to the pipeline from the cylinder of the pump.

12. The method of claim 7 wherein predicting wear on components of the pump and pipeline further comprises:

sensing a pressure indicative parameter which bears a known relationship to a pressure of concrete delivered to the pipeline from the cylinder of the pump;

determining pressure information as a function of the sensed pressure indicative parameter, the pressure information being related to a pressure of concrete delivered to the pipeline from the cylinder of the pump; and predicting wear on components of the pump and pipeline as a function of the velocity information and as a function of the pressure information.

13. The method of claim 1 wherein determining pressure information further comprises:

determining an average pressure of concrete delivered to the pipeline from the cylinder of the pump.

* * * * *

UNITED STATES PATENT AND TRADEMARK OFFICE

CERTIFICATE OF CORRECTION

PATENT NO. : 5,332,366

DATED : July 26, 1994

INVENTOR(S) : THOMAS M. ANDERSON

It is certified that error appears in the above-indentified patent and that said Letters Patent is hereby corrected as shown below:

On the Title Page, insert --[73] Assignee: Schwing America, Inc., White Bear Lake, Minn.

Col. 5, line 59, delete "than", insert --then--

Col. 9, line 50, delete "predetermine", insert --predetermined--

Col. 11, line 8, delete "stroked", insert --strokes--

Col. 12, line 26, delete "claim 1", insert --claim 12--

Signed and Sealed this

Twenty-first Day of March, 1995

*Attest:*

Bruce Lehman

BRUCE LEHMAN

*Attesting Officer*

*Commissioner of Patents and Trademarks*